US007287603B2

(12) United States Patent
Hay et al.

(10) Patent No.: US 7,287,603 B2
(45) Date of Patent: Oct. 30, 2007

(54) COMBINED CASING EXPANSION/CASING WHILE DRILLING METHOD AND APPARATUS

(75) Inventors: Richard T. Hay, St. Albert (CA); Gerald Edward Kent, Spruce Grove (CA); Jerry Lavelle Keen, Jr., Spring, TX (US); Charles M. Reid, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 234 days.

(21) Appl. No.: 10/496,310

(22) PCT Filed: Sep. 5, 2003

(86) PCT No.: PCT/CA03/01362

§ 371 (c)(1),
(2), (4) Date: Jun. 28, 2005

(87) PCT Pub. No.: WO2004/022913

PCT Pub. Date: Mar. 18, 2004

(65) Prior Publication Data

US 2005/0247485 A1 Nov. 10, 2005

(30) Foreign Application Priority Data

Sep. 6, 2002 (CA) ..... 2401813

(51) Int. Cl.
*E21B 7/20* (2006.01)

(52) U.S. Cl. ..... 175/57; 166/207; 166/277; 166/380; 166/384; 175/171; 175/317; 175/321; 175/322

(58) Field of Classification Search ..... 166/207, 166/277, 380, 384; 175/57, 171, 317, 321, 175/322

See application file for complete search history.

(56) References Cited

U.S. PATENT DOCUMENTS 5,197,553 A 3/1993 Leturno (Continued)

FOREIGN PATENT DOCUMENTS

CA 1226274 9/1987

OTHER PUBLICATIONS

"Adjustable Gauge Stabilizer (AGS TM) Operations Manual", Sperry-Sun Drilling Services, undated, 62 pages.

*Primary Examiner*—George Suchfield
(74) *Attorney, Agent, or Firm*—Terrence N. Kuharchuk; William Shull; Emery Jamieson LLP

(57) ABSTRACT

A drilling assembly (2) comprises upper (4) and lower (6) drill strings with a fluid passage (80) therethrough for distributing fluid to a bottom hole assembly (10). The upper drill string (4) has an upper end (11) connectable to a drilling apparatus (13) and fluid source (16) and a lower end (18) with an attached casing expander unit (20) that communicates the fluid passage (80) of the upper (4) and lower (6) drill strings. An upper end (22) of the lower drill string (6) is formed from a casing string (24) telescoped over the casing expander unit. A constriction (31) connects the casing string (24) with the rest of the lower drill string (6). A flow restriction device (35) in the lower drill string acts to control fluid flow through the fluid passage. In use, the flow restriction device creates a pressure in the fluid passage that acts at the constriction to advance the lower drill string past the upper drill string while simultaneously expanding the portion of the casing string moving past the expander unit.

44 Claims, 4 Drawing Sheets

U.S. PATENT DOCUMENTS 5,271,472 A 12/1993 Leturno
5,472,057 A 12/1995 Winfree
6,158,533 A 12/2000 Gillis et al.
6,439,321 B1 8/2002 Gillis et al.
6,640,903 B1 * 11/2003 Cook et al. ..... 166/380
7,117,957 B2 * 10/2006 Metcalfe et al. ..... 175/57
7,178,601 B2 * 2/2007 Burge ..... 166/380
2002/0060078 A1 5/2002 Stewart et al.
2004/0216925 A1 * 11/2004 Metcalfe et al. ..... 175/57
2004/0221996 A1 * 11/2004 Burge ..... 166/380

* cited by examiner

COMBINED CASING EXPANSION/CASING WHILE DRILLING METHOD AND APPARATUS

FIELD OF THE INVENTION

This invention relates to drilling tools and methods and is specifically concerned with a casing drilling system in which a casing string is run into the wellbore with the drilling string and expanded while the drilling string is in the wellbore.

BACKGROUND OF THE INVENTION

The drilling of wells for oil and gas production conventionally employs relatively small diameter drilling pipe joined end to end to form a drill string to which is secured the necessary equipment including a drill bit for creating a wellbore which is of larger diameter than the drilling pipe. After a portion of the wellbore has been drilled, the wellbore is usually lined with a string of tubular casing member joined end to end to define a casing string. This conventional approach requires a cycle of drilling the wellbore, pulling the drill string out of the wellbore to the surface and running casing into the wellbore. The process is time consuming and costly.

The technique of casing drilling has been developed to address the problems of conventional drilling. The casing drilling process involves running a casing string into the wellbore with the drilling string.

Using either of the above techniques, a wellbore may be drilled and then cased to a certain depth, and then the drilling apparatus removed. If the depth of the wellbore is ever later to be extended, it is not possible to reinsert the drilling apparatus into the cased wellbore without resorting to a smaller diameter casing string. As different lower segments of the wellbore are drilled, successively smaller diameter casing strings are required in order to pass through the casing strings above.

SUMMARY OF THE INVENTION

To address these and other disadvantages of the prior art, applicant has developed a casing drilling apparatus and method which involves alternating between drilling and casing expansion operations under two different drilling fluid pressure regimes in order to insert and expand casing string into the wellbore while the drill string remains in the wellbore. The present invention therefore allows for formation of a "monobore" well with substantially the same diameter over the total depth. This is made possible by expanding a portion of casing after it is placed in the wellbore and after it passes through the segment of casing before it.

Accordingly, the present invention provides a drilling assembly comprising:

an upper drill string and a lower drill string;

a fluid passage extending through the upper drill string and the lower drill string for distributing fluid to a bottom hole assembly at the lower end of the lower drill string;

the upper drill string having an upper end connectable to a drilling apparatus and fluid source and having a lower end with an attached casing expander unit that communicates the fluid passage of the upper drill string with the lower drill string;

the lower drill string having an upper end formed from a casing string telescoped over the casing expander unit;

a constriction connecting the casing string with the rest of the lower drill string; and a flow restriction device in the lower drill string to control flow of fluid through the fluid passage;

wherein the flow restriction device is operable to create a pressure in the fluid passage that acts at the constriction to advance the lower drill string past the upper drill string while simultaneously expanding the portion of the casing string moving past the expander unit.

In another aspect, the present invention provides a method of drilling a wellbore comprising the steps of:

forming a drilling assembly comprising an upper drill string and a lower drill string which is telescoped over the upper drill string with a fluid passage extending through the upper drill string and the lower drill string for distributing fluid to a bottom hole assembly at the lower end of the lower drill string;

operating the drilling assembly according to the following cycle:

drilling a segment of a wellbore with the bottom hole assembly;

stopping drilling and retreating the drill string from the end of the segment of the wellbore;

advancing the lower drill string past the upper drill string and simultaneously expanding a portion of a casing string at the upper end of the lower drill string by virtue of movement of the casing string past the upper drill string; and repeating the cycle when the lower drill string reaches the end of the segment of the wellbore until the desired wellbore depth is achieved.

The present invention offers increased drilling speed by reducing the time spent expanding the casing and eliminating the need to withdraw the drill string from the wellbore to insert casing. Reduced drilling costs also result due to a reduction in drilling time and elimination of steps and equipment used in the conventional drilling process.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

In the following description, in referring to the position of components in the drill strings, "above", "up", "upper" and the like describe relative positions closer to the ground surface while "below", "down", "lower" and the like describe relative positions closer to the bottom of the wellbore.

Figure 1:
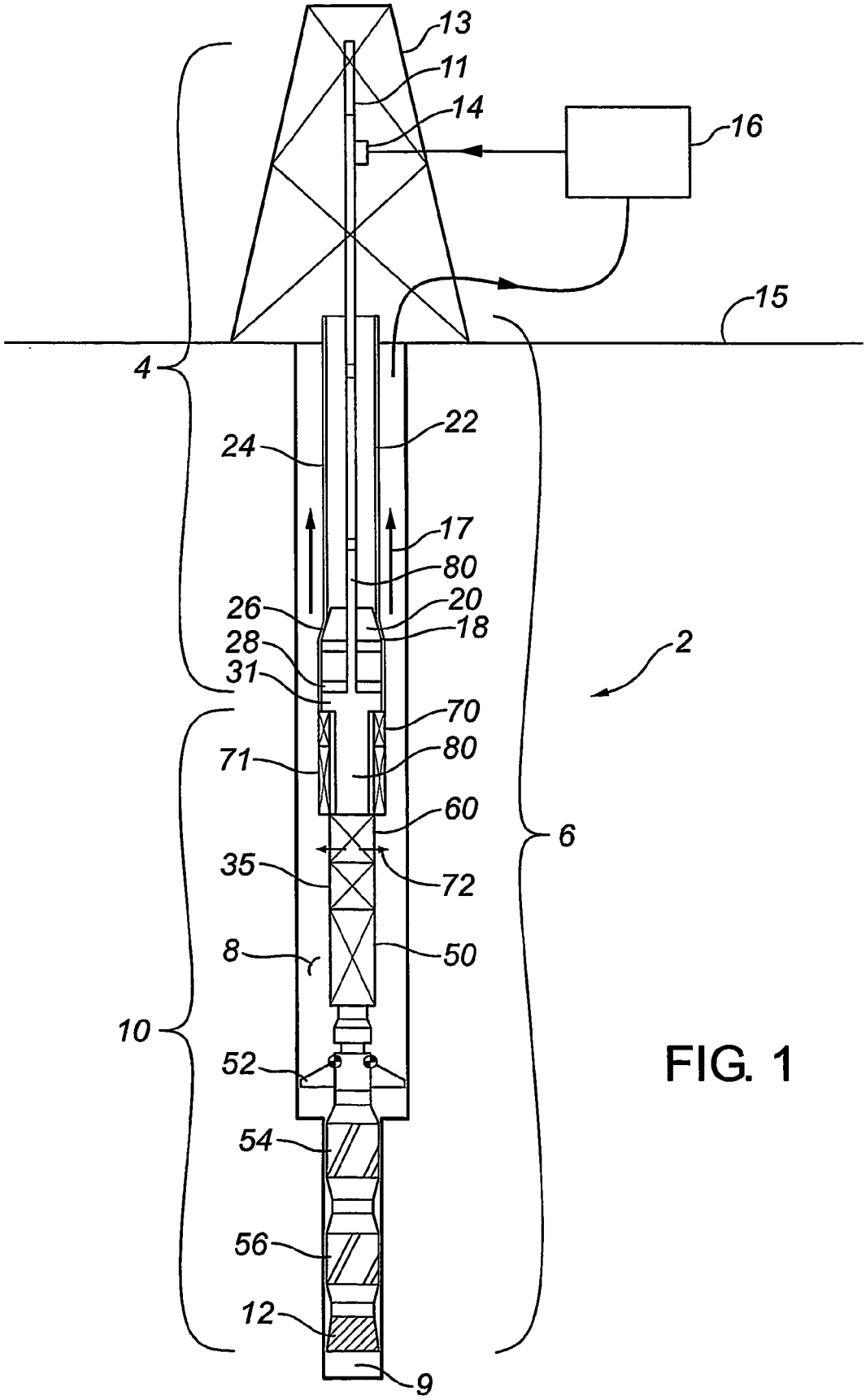
FIG. 1 is a schematic cross sectional view of a preferred embodiment of the drilling assembly of the present invention in a wellbore for use primarily in sliding drilling.

Referring to FIG. 1, there is shown in schematic form an embodiment of a drilling system according to the present invention intended for sliding drilling. The drilling assembly 2 comprises an upper drill string 4 and a lower drill string 6 adapted for insertion into a wellbore 8 created by the drilling assembly. The lower end 9 of lower drill string 6 includes a bottom hole assembly (BHA) 10 which includes a drill bit 12, for example, a roller cone bit. A fluid passage 80 extends through upper drill string 4 and lower drill string 6 for distributing drilling fluid, also, for example, known as drilling "mud", to bottom hole assembly 10 to permit operation of drill bit 12. Upper drill string 4 has an upper end 11 that is connectable to and supported by a drilling apparatus 13 such as a derrick at a surface 15. The surface 15 maybe any surface from which drilling may be conducted, including a ground surface or an offshore drilling platform.

Drilling fluid from fluid source 16 is introduced under pressure into the fluid passage 80 via port 14. Used fluid exits the lower drill string 6 at drill bit 12 and serves to lubricate and cool the bit. The used fluid mixed with material dislodged by drill bit 12 drill flows upwards as indicated by arrows 17 through wellbore 8 in the annular passage external to the drill strings 4 and 6. This annular passage is sealed at surface level to permit collection of the used fluid for filtering and recycling through reservoir 16.

Figure 2:
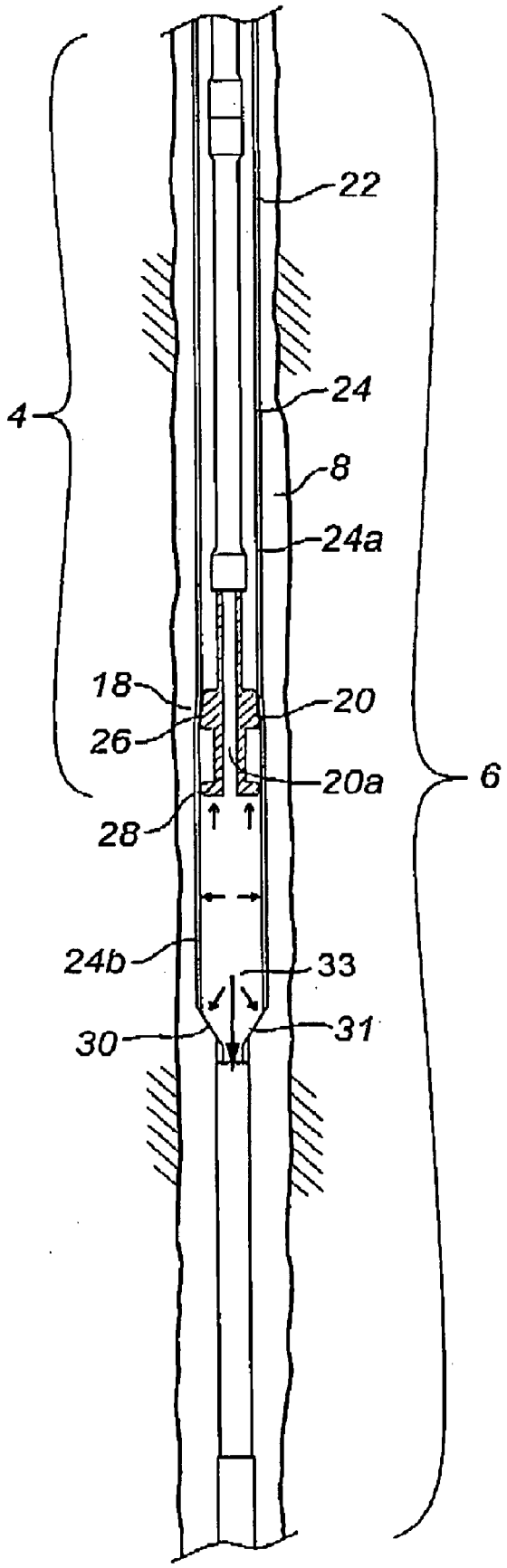
FIG. 2 is a detail view of a section of the drill assembly showing the lower end of the upper drill string including the casing expander unit and the constriction in the lower drill string.

As best shown in FIG. 2, the lower end 18 of upper drill string 4 opposite supported upper end 11 includes an attached casing expander unit 20. The casing expander unit includes a passage 20*a* therethrough that communicates the fluid passage 80 of upper drill string 4 with the fluid passage 80 of lower drill string 6.

The upper end 22 of lower drill string 6 is formed from a casing string 24 that is telescoped over casing expander unit 20 such that the lower drill string 6 essentially "hangs" on the casing expander unit 20. The lower drill string 6 is maintained in place due to friction plus static pressure between casing string 24 and casing expander unit 20. Alternatively, the lower drill string 6 may be connectable to and supported by the drilling apparatus 13 in similar manner as the upper drill string 4.

The casing expander unit 20 may be comprised of any device, structure or apparatus over which the casing can be moved in order to expand the casing.

In the preferred embodiment, casing expander unit 20 is formed with a generally frusto-conical shoulder 26 that expands outwardly downwardly and forces casing that is moved downwardly past the unit to expand outwardly. Shoulder 26 is shaped and dimensioned to impart an expanding force to a casing that is moved over the shoulder. The expanding force deforms a casing member to a larger internal diameter. In other words, above casing expander unit 20, there is a casing string portion 24*a* of a first diameter, while below the expander unit, there is an expanded casing string portion 24*b* of an enlarged diameter. Casing expander unit 20 also preferably includes an annular shoulder 28 spaced apart from frusto-conical shoulder 26 to guide movement of the expanding casing string and to prevent binding of the casing. Shoulder 26 and/or shoulder 28 may also act as an upper seal for expanded casing portion 24*b* which functions as a section of the drill string fluid passage 80.

Lower drill string 6 includes a constriction 31 that connects the expanded portion 24*b* of casing string 24 with the rest of the lower drill string 6 and communicates the fluid passage 80 through the expanded casing assembly with the fluid passage 80 of the rest of lower drill string 6. The constriction 31 may be comprised of any device, structure or apparatus which is capable of providing a narrowing transition from the casing string to the rest of the lower drill string 6. The functions of the constriction 31 are to convert fluid pressure from within the fluid passage 80 to a downward force acting on the lower drill string 6 and to provide a transition between the casing and the rest of the lower drill string 6.

Referring to FIG. 1, in a preferred embodiment the constriction 31 in the lower drill string 6 is preferably formed by inserting a latch coupling 71 between the expanded casing string portion and the rest of lower drill string 6. A packer seal 70 is positioned above the latch coupling 71 to seal the unit and prevent loss of fluid about the exterior of the latch coupling 71.

FIG. 2 is a detail view of the upper end of the lower drill string 6 and illustrates an alternative constriction 31 in the form of a funnel subassembly 30. Funnel assembly 30 provides a smooth transition that connects the expanded portion 24*b* of casing string 24 with the rest of the lower drill string 6. As with the latch coupling 71 arrangement, the fluid passage 80 extending through upper drill string 4 is communicated with the lower drill string 6 via funnel assembly 30.

A pup joint may be used to connect constriction 31 with the rest of the lower drill string 6.

Figure 3:
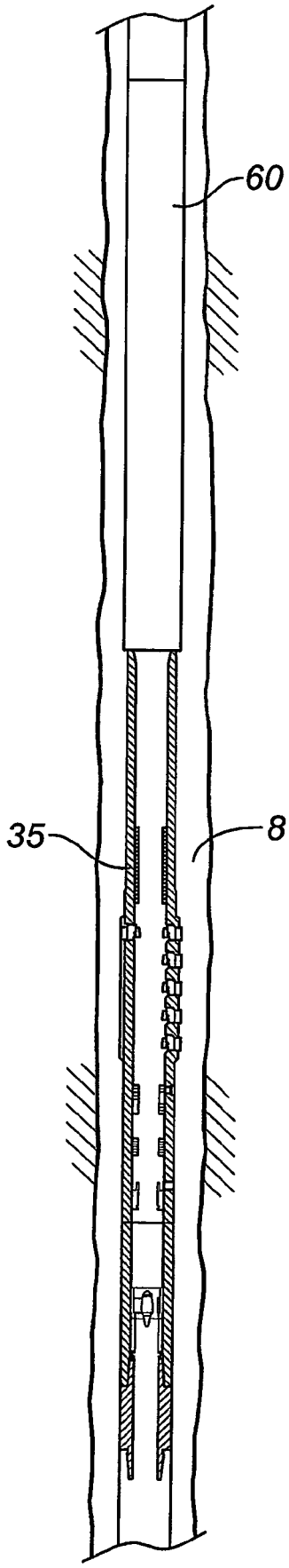
FIG. 3 is a detail view of a section of the drill assembly showing a flow restriction device for controlling fluid flow within the drill string.

As shown in FIGS. 1 and 3, lower drill string 6 also includes a flow restriction device 35 to control flow of fluid through the fluid passage 80 and control overall operation of the drilling assembly.

When the drilling apparatus of the present invention is operated to expand casing, flow restriction device 35 is operated to restrict flow and create an elevated pressure in the fluid passage 80 above the flow restriction device that acts at constriction 31 and at flow restriction device 35 to advance lower drill string 6 past upper drill string 4 while simultaneously expanding the portion of casing string 24 moving past expander unit 20. In contrast, when drilling, the flow restriction device 35 is set to permit substantially unrestricted flow of drilling fluid to drill bit 12. In other words, flow restriction device 35 operates as a bi-pressure subassembly to create two pressure regimes within the drill strings 4 and 6 to switch the drilling assembly between a drilling mode and a casing insertion and expansion mode. The drilling assembly alternates between these two modes to perform its work.

Some development work has been done directed to the notion of simultaneously drilling and expanding the casing by always operating in a high flow, high pressure mode. This technique is not considered workable since the high pressures required for casing expansion are incompatible with lower pressures which are suitable and safe for drilling. Also, the rate of casing expansion is expected to be at least an order of magnitude greater than the drilling penetration mode, depending on conditions, and the forces required for these two modes of operation are likewise incompatible. An important feature of the present invention is the provision of two different pressure regimes in the fluid passage 80 that allow for alternating between the drilling mode and the casing insertion and expansion modes instead of performing these operations simultaneously.

The flow restriction device 35 may be comprised of any structure, device or apparatus which is capable of alternately providing two different pressure regimes in the drill strings 4 and 6. The flow restriction device 35 may be configured to be actuated between the pressure regimes in any manner. For example, the flow restriction device 35 may be actuated by longitudinal or rotational manipulation of the drilling strings 4 and 6 or by pressure or flow variations of drilling fluid in the fluid passage 80.

One device suitable for use as a flow restriction device 35 in the present invention is a bi-pressure subassembly which includes a barrel cam with detents which is movable between positions to control flow of fluid through the unit. The barrel cam is activated by pressure changes in the fluid introduced by cycling the pumps that pump the fluid. One example of equipment that could be adapted to function as a bi-pressure subassembly is the Adjustable Gauge Stabilizer (AGS™) manufactured by Sperry-Sun Drilling Services. The operation of this subassembly is described in the Adjustable Gauge Stabilizer (AGS™) Operations manual which is incorporated herein by reference.

U.S. Pat. No. 6,158,533 to Gillis et al. discloses an Adjustable Gauge Downhole Drilling Assembly (Adjustable Gauge Motor (AGM™))that includes a similar barrel cam apparatus and is also incorporated herein by reference.

As adapted for use in the present invention, the AGS™ and the AGM™ are both able to operate in both an unrestricted fluid flow mode and a restricted fluid flow mode to switch the drilling assembly between drilling mode and casing insertion and expansion mode, respectively.

Depending upon the application of the invention and the design of the bottom hole assembly 10, a flow restriction device 35 which comprises an apparatus similar to that of the AGS™ or the AGM™ may or may not include the function of an adjustable gauge stabilizer. In other words, the structures of the AGS™ and the AGM™ are adapted for use with the invention primarily because of their capability to provide two alternating pressure regimes in the drill strings 4 and 6.

FIG. 3 provides a detail section view through an AGS™ subassembly which includes a barrel cam actuator and a movable orifice to control fluid flow through the subassembly. Additional detail of these and other components of this embodiment of flow restriction device 35 may be obtained from the documents which are incorporated by reference.

A second device which is potentially suitable to be adapted for use as the flow restriction device 35 is disclosed in U.S. Pat. No. 6,439,321 to Gillis et al for a Piston Actuator Assembly for an Orienting Device. This device comprises a longitudinally movable piston which provides a first partial obstruction and a flow restrictor which provides a second partial obstruction. The first partial obstruction and the second partial obstruction may be selectively aligned or misaligned to provide two different pressure regimes. U.S. Pat. No. 6,439,321 is incorporated herein by reference.

Figure 4:
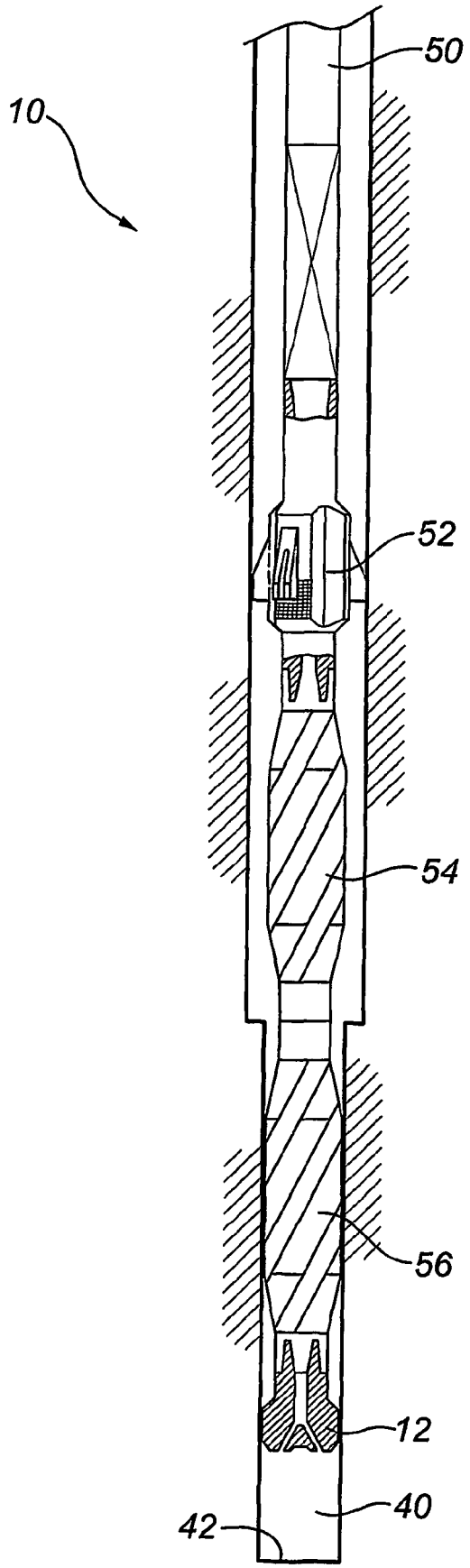
FIG. 4 is a detail view of a section of the drill assembly showing the bottom hole assembly including the downhole motor and the drill bit in a position retreated from the bottom of a pilot hole which defines an end of a drilled segment of a wellbore.

Referring to FIG. 4, there is shown a preferred arrangement of a bottom hole assembly 10 for use with the drilling assembly of the present invention. The bottom hole assembly includes a downhole drilling motor 50 that is operated by fluid pressure, an underreamer 52, a stabilizer 54, a near-bit stabilizer 56 and drilling bit 12. This particular bottom hole assembly is intended for sliding drilling due to the presence of downhole motor 50.

It will be appreciated by those skilled in the art that not all the components of bottom hole assembly 10 illustrated in FIG. 4 are necessarily required in all applications of the drilling system of the present invention. For example, it may not always be necessary to have an underreamer or stabilizers. In addition, the stabilizers may be different in number and in position within the bottom hole assembly. The bottom hole assembly can also include subassemblies for steering the drill bit in directional drilling applications. The illustrated and described embodiments of the present invention are directed to essentially vertical wellbores. It will be apparent to one skilled in the art that the drilling system of the present invention can be used in non-vertical drilling applications.

In addition, measurement-while-drilling (MWD) systems can be used with the drilling apparatus of the present invention. Typically, such systems are used to sense and communicate properties such as drilling temperatures, pressures, azimuth and inclination and would be installed in the lower drill string 6 above bottom hole assembly 10 to readily transmit data from the wellbore 8 to the surface.

When used in conjunction with the sliding drilling bottom hole assembly 10 described above and illustrated in FIG. 4, the bi-pressure subassembly 35 is cycled "Pumps Off-Pumps On" to shift the unit into full flow, low backpressure operation with substantially unrestricted flow of drilling fluid through the subassembly. The subassembly is selected to be of sufficient size and rating to handle the flow volume and pressure. The flow of drilling fluid through the bi-pressure subassembly drives motor 50, deploys the cutter arms on underreamer 52 and supplies coolant fluid to drill bit 12 in order to drill ahead into pilot hole 40 by advancing upper drill string 4 and lower drill string 6 together into the wellbore 8. New drill joints are added to the upper end 11 of upper drilling string 4 and new casing joints are added to the upper end 22 of lower drilling string 6 as the drilling assembly is fed into the wellbore 8. The downward force on drill bit 12 or weight on bit (WOB) is provided primarily by the weight of the drilling strings above the drill bit. At low pressure, relative movement between the upper drill string 4 and the lower drill string 6 is prevented by the friction between casing expander unit 20 and casing string 24 and by the fluid pressure exerted on constriction 31 by passage of the drilling fluid through the drilling strings 4 and 6.

Once a segment of the wellbore 8 has been drilled a desired distance, the bi-pressure subassembly 35 is cycled by a "Pumps Off-Pumps On" sequence of the pumps at the surface supplying the drilling fluid to shift the unit into high backpressure operation in which fluid flow is reduced to the motor, underreamer and bit to such an extent that these components stop functioning. It is contemplated that the flow through the bi-pressure subassembly 35 in this restricted flow position will be extremely small. In other words, the passage through the subassembly will be very small in the restricted flow position. This can be achieved by selecting an appropriate orifice size for the subassembly.

With drilling halted by stopping of the drill bit, the drill strings 4 and 6 are retracted from the surface to retreat drill bit 12 from the bottom 42 of the pilot hole 40. This position of drill strings 4 and 6 is shown in FIGS. 1 and 4. Preferably the drill strings 4 and 6 are retracted before a high pressure regime is created in the drill strings 4 and 6 so that the lower drill string 6 is not inadvertently impacted against the bottom of the wellbore 8. In other words, preferably the drill strings 4 and 6 are retreated after the "Pumps Off" portion but before the "Pumps On" portion of the "Pumps Off-Pumps On" sequence.

When using the bottom hole assembly 10 illustrated in FIG. 4, the drill strings 4 and 6 are preferably only lifted far enough so that near bit stabilizer 56 remains at least partially located in pilot hole 40 to ensure that the lower drill string 6 remains centred in the full wellbore 8. Backpressure builds in the fluid passage 80 above the bi-pressure subassembly 35, and is allowed to reach a level sufficient to begin pushing lower drill string 6 back towards the bottom 42 of pilot hole 40. As best shown in FIG. 2, increased pressure is exerted equally in all directions at constriction 31, however, since the upper drill string 4 is held stationary with respect to the surface, pressure forces at the lower end of the funnel result in a net downward force being exerted at constriction 31 and at flow restriction device 35 as indicated by arrow 33 (arrows not shown for 35). Referring to FIG. 1, casing expander unit 20 is held stationary with respect to the surface 15 by virtue of being attached to the lower end 18 of upper drill string 4 which is supported by drill derrick 13. To accommodate downward movement of the lower drill string 6, a length of the upper casing portion 22 of lower drilling string 6 must telescope past conical shoulder 26 of casing expander unit 20 which causes expansion of the casing to an enlarged internal diameter.

While the illustration of FIG. 4 shows a relatively short length of pilot hole 40, it is contemplated that the drilling phase can be conducted over distances on the order of hundreds of feet or more before drilling is stopped, the drill bit is retreated and casing is inserted and expanded over the length of the newly created section.

In most applications, it is preferable that sealed junctions be provided between adjacent segments of casing string 24 In other words, the upper end of a lower segment of casing should preferably be sealingly connected to the lower end of an upper segment of casing. This can be accomplished as a lower segment of casing is expanded, and may involve the use of a rubber cladding on the surfaces of the casing at the ends of the casing. These techniques are already extant in the prior art.

This sealed junction is optional and may not always be required. In fact, in some applications, there may actually be gaps in the borehole between segments of casing.

Fluid flow through the fluid passage 80 is stopped to halt the downward movement of lower drill string 6 and expansion of the casing before drill bit 12 reaches the bottom 42 of pilot hole 40. This may, for example, be achieved by initiating a further "Pumps Off-Pumps On" sequence in order to initiate the drilling of a further segment of wellbore 8. Alternatively, fluid flow may simply be stopped to facilitate an interruption in drilling and casing expansion operations.

There is a potential danger of accidentally "tagging bottom" with the drill bit and underreamer assemblies traveling at full casing insertion and expansion speed. To prevent damage to these components, which would significantly disrupt the entire drilling operation, it is preferable to provide safeguards against this potential danger. Such safeguards may include a device, structure or apparatus for dissipating pressure within the fluid passage 80 in response to an occurrence of tagging bottom or a device, structure or apparatus for absorbing the impact associated with an occurrence of tagging bottom. One or both of these safeguards may be provided and may be provided in one or a plurality of devices, structures or apparatus.

In a preferred embodiment, both safeguards are provided in a single apparatus, which apparatus comprises a shock absorbing unit 60 located above bi-pressure subassembly 35, preferably in the lower drill string 6. Such a unit is shown schematically in FIG. 1. Preferably, shock absorbing unit 60 is a modified shock tool which acts to relieve pressure on contact. Unit 60 includes a spring biased piston which normally covers relief ports. As the shocktool compresses when the drill bit is moved against the bottom of the hole, the springs compress, the piston moves, and the ports become exposed, thus releasing fluid from the fluid passage 80 as shown by arrows 72. The escape of fluid instantly reduces the backpressure and hence the downward pressure exerted at constriction 31, thereby interrupting the casing insertion and expansion process.

Details of a conventional two-way shock tool or shock absorbing tool which could be adapted for use with the invention can be found in Canadian Patent No. 1,226,274 to Wenzel, which is incorporated herein by reference.

Other mechanisms could be used to accomplish the goal of providing safeguards against damage to the bottom hole assembly 10 due to impact under high fluid pressure. Safeguards directed at dissipating the pressure within the fluid passage 80 should generally be located above the flow restriction device 35 (in either the upper drill string 4 or the lower drill string 6).

Safeguards directed at absorbing the impact of the drill bit 12 at the end of the wellbore 8 may be located at any position in the upper drill string 4 or the lower drill string 6 but are preferably located in the lower drill string 6 in relative close proximity to the bottom hole assembly 10. Where both safeguards are integrated in a single device, structure or apparatus, this device, structure or apparatus should therefore be located above the flow restriction device 35 in either the upper drill string 4 or the lower drill string 6.

A particular advantage of the drilling apparatus and method of the present invention is that it permits the resumption and extension of a wellbore 8 that has already been cased to a certain depth without introducing progressively reduced diameter sections. Using conventional drilling techniques, it is not possible to reinsert the drilling apparatus into the cased wellbore 8 without resorting to a smaller diameter casing string. As different lower segments of the wellbore 8 are drilled, successively smaller diameter casing strings are required in order to pass through the casing strings above. With the apparatus and method of the present invention, it is possible to install subsequent casing strings in each new section as the casing strings are movable through the existing pre-expanded wellbore 8 for expansion after they are positioned in the newly drilled portion of the wellbore 8. When the drilling assembly of the present invention is used in this manner to extend an existing cased well, upper drill string 4 is extended into the well to a point adjacent the end of the installed casing to position the casing expansion unit 20 to begin expansion of the new casing string at a location that preferably results in some overlap of the casing strings.

In practice, it is sometimes necessary to retrieve the bottom hole assembly 10 from the end of the drilling strings if a component breaks or if drilling is completed. If constriction 31 is formed from latch coupling 71, the latch coupling 71 provides a convenient point of retrieval for the bottom hole assembly to facilitate removal. One alternative retrieval mechanism that can be incorporated in the bottom hole assembly of the present invention is described in U.S. Pat. No. 5,197,553 (Leturno) or U.S. Pat. No. 5,271,472 (Leturno) which are incorporated herein by reference. A second alternative retrieval mechanism is also discussed in U.S. Pat. No. 5,472,057 (Winfree) which is also incorporated herein by reference. Other retrieval mechanisms for the bottom hole assembly or portions thereof may also be used with the invention.

The foregoing description primarily details a drilling system according to the present invention that relies on a sliding drilling arrangement using a downhole drilling motor 50 as shown in FIG. 1. It will be appreciated that the present invention is not limited to this arrangement. The drilling system can also be used in a rotary drilling arrangement in which the lower drill string 4 or both drill strings 4 and 6 are rotated from the surface.

In the rotary drilling arrangement, downhole motor 50 may not be required. Instead, the drill bit 12 may be driven by rotation of either or both of the drill strings 4 and 6.

If both the upper drill string 4 and the lower drill string 6 are to be rotated, then consideration must be given to ensuring that the drill strings 4 and 6 rotate together. The frictional forces between the upper drill string 4 and the lower drill string 6 at the location of the casing expander unit 20 may or may not be sufficient to transmit torque from the upper drill string 4 to the lower drill string 6. It may therefore be necessary either to rotate both of the drill strings 4 and 6 simultaneously from the surface or to provide a more positive mechanism for ensuring that torque can be transmitted from the upper drill string 4 to the lower drill string 6. Such a mechanism may comprise a latch mechanism or splines, ridges or grooves in engaging surfaces of the upper drill string 4 and the lower drill string 6.

Alternatively, if only the lower drill string 6 is to be rotated during rotary drilling, a bearing assembly (not shown) at casing expander unit 20 would be required to accommodate rotation of the casing string relative to the casing expander unit 20 when in drilling mode.

The invention may also be utilized with a combination of rotary drilling and sliding drilling techniques by combining the features of both the sliding drilling embodiments and the rotary drilling embodiments as described above and by incorporating a downhole motor 50 in the bottom hole assembly 10 even where rotary drilling is contemplated.

While a downhole motor 50 in the bottom hole assembly 10 may be unnecessary in a rotary drilling arrangement, a drilling fluid restriction device 35 is still required to provide lubricating drilling fluid to the drill bit during drilling mode and to develop the necessary high pressure in the fluid passage 80 to permit expansion of the casing during casing expansion mode.

It may, however, be possible for some applications of the invention to eliminate the constriction 31 if sufficient force can be developed at the flow restriction device 35 to permit expansion of the casing during casing expansion mode. This possibility depends upon the extent to which the flow restriction device 35 restricts flow in the fluid passage 80 when the flow restriction device 35 is in casing expansion mode. This possibility also depends upon the ability to provide a transition between the casing and the rest of the lower drill string 6 without the constriction 31.

Alternatively, it may be possible to combine the functions of the constriction 31 and the flow restriction device 35 at a single location in the lower drill string 6 instead of at longitudinally spaced locations. An integrated constriction 31 and flow restriction device 35 could for example provide a transition between the casing and the rest of the lower drill string 6, convert fluid pressure within the fluid passage 80 to a downward force acting on the lower drill string 6, and provide for two different pressure regimes.

Although the present invention has been described in some detail by way of example for purposes of clarity and understanding, it will be apparent that certain changes and modifications may be practised within the scope of the appended claims.

We claim:

1. A drilling assembly comprising:

an upper drill string and a lower drill string;

a fluid passage extending through the upper drill string and the lower drill string for distributing fluid to a bottom hole assembly at the lower end of the lower drill string;

the upper drill string having an upper end connectable to a drilling apparatus and fluid source and having a lower end with an attached casing expander unit that communicates the fluid passage of the upper drill string with the lower drill string;

the lower drill string having an upper end formed from a casing string telescoped over the casing expander unit;

a constriction connecting the casing string with the rest of the lower drill string; and a flow restriction device in the lower drill string to control flow of fluid through the fluid passage;

wherein the flow restriction device is operable to create a pressure in the fluid passage that acts at the constriction to advance the lower drill string past the upper drill string while simultaneously expanding the portion of the casing string moving past the expander unit.

2. A drilling assembly as claimed in claim 1 in which the drilling assembly is a sliding drilling assembly and the bottom hole assembly includes a downhole motor driven by fluid to rotate an attached drill bit.

3. A drilling assembly as claimed in claim 2 in which the bottom hole assembly includes a reamer subassembly.

4. A drilling assembly as claimed in claim 2 in which the bottom hole assembly includes at least one stabilizer subassembly.

5. A drilling assembly as claimed in claim 2 in which the downhole motor is positioned after the flow restriction device which is used to control fluid flow to the motor.

6. A drilling assembly as claimed in claim 1 in which the drilling assembly is a rotary drilling assembly and the bottom hole assembly includes a drill bit that is rotated by rotation of the upper and lower drill strings.

7. A drilling assembly as claimed in claim 1 in which the bottom hole assembly includes a drill bit that is drivable by a combination of rotary drilling from the surface and a downhole motor in the bottom hole assembly.

8. A drilling assembly as claimed in claim 1 including a pressure relief unit in the lower drill string before the flow restriction device.

9. A drilling assembly as claimed in claim 1 including a shock absorbing unit in the lower drill string before the flow restriction device.

10. A drilling assembly as claimed in claim 1 in which the constriction is formed at a latch coupling.

11. A drilling assembly as claimed in claim 10 in which the latch coupling is sealed by a packer seal.

12. A method of drilling a wellbore comprising:

forming a drilling assembly comprising an upper drill string and a lower drill string which is telescoped over the upper drill string with a fluid passage extending through the upper drill string and the lower drill string for distributing fluid to a bottom hole assembly at the lower end of the lower drill string;

operating the drilling assembly according to the following cycle;

drilling a segment of a wellbore with the bottom hole assembly;

stopping drilling and retreating the bottom hole assembly from an end of the segment of the wellbore;

advancing the tower drill string past the upper drill string and simultaneously expanding a portion of a casing string at the upper end of the lower drill string by virtue of movement of the casing string past the upper drill string;

repeating the cycle when the lower drill string reaches the end of the segment of the wellbore until the desired wellbore depth is achieved.

13. A method as claimed in claim 12 in which advancing the lower drill string past the upper drill string includes controlling the flow of fluid in the fluid passage to increase the pressure in the drill string to cause relative movement of the lower drill string with respect to the upper drill string and to expand the casing string.

14. A method as claimed in claim 13 wherein controlling fluid flow in the fluid passage involves actuating a flow restriction device in the lower drill string to create increased pressure in the drill string above the flow restriction device.

15. A method as claimed in claim 13 including forming a constriction in the lower drill string to provide a location for the pressure to exert a net downward force on the lower drill String.

16. A method as claimed in claim 13 including providing a casing expander unit at a lower end of the upper drill string which acts to expand the portion of the casing string moving past the expander unit.

17. A drilling assembly comprising:

an upper drill string and a lower drill string;

a fluid passage extending through the upper drill string and the lower drill string for distributing fluid to a bottom hole assembly at a lower end of the lower drill string;

the upper drill string having an upper end connectable to a drilling apparatus and fluid source and having a lower end with an attached casing expander unit that communicates the fluid passage of the upper drill string with the lower drill string;

the lower drill string having an upper end formed from a casing string telescoped over the casing expander unit, wherein the casing string is connected with a remainder of the lower drill string forming the lower end of the lower drill string;

a constriction connecting the casing string with the remainder of the lower drill string; and a flow restriction device in the lower drill string to control a flow of fluid through the fluid passage;

wherein the flow restriction device is alternately actuatable between a first Pressure regime to provide a drilling mode of the drilling assembly wherein the flow of fluid through the fluid passage to the bottom hole assembly is substantially unrestricted and a second pressure regime to provide a casing insertion and expansion mode of the drilling assembly wherein the flow of fluid through the fluid passage to the bottom hole assembly is restricted, thereby creating a pressure in the fluid passage that acts at the constriction to advance the lower drill string past the upper drill string while simultaneously expanding the portion of the casing string moving past the expander unit, and wherein actuation of the flow restriction device switches the drilling assembly between the drilling mode and the casing insertion and expansion mode.

18. A drilling assembly as claimed in claim 17 in which the drilling assembly is a sliding drilling assembly and the bottom hole assembly includes a downhole motor driven by fluid to rotate an attached drill bit.

19. A drilling assembly as claimed in claim 18 in which the downhole motor is positioned after the flow restriction device which is used to control fluid flow to the motor.

20. A drilling assembly as claimed in claim 17 in which the drilling assembly is a rotary drilling assembly and the bottom hole assembly includes a drill bit that is rotated by rotation of the upper and lower drill strings.

21. A drilling assembly as claimed in claim 17 in which the bottom hole assembly includes a drill bit that is drivable by a combination of rotary drilling from the surface and a downhole motor in the bottom hole assembly.

22. A drilling assembly as claimed in claim 17 wherein the bottom hole assembly is comprised of a drill bit for drilling a wellbore.

23. A drilling assembly as claimed in claim 22 wherein the remainder of the lower drill string is comprised of the flow restriction device.

24. A drilling assembly as claimed in claim 23 wherein the flow restriction device is comprised of a bi-pressure subassembly alternately actuatable between the first pressure regime and the second pressure regime.

25. A drilling assembly as claimed in claim 24 wherein the flow of fluid through the fluid passage to the bottom hole assembly is substantially obstructed upon actuation of the bi-pressure subassembly to the second pressure regime to provide the casing insertion and expansion mode.

26. A drilling assembly as claimed in claim 24, wherein the lower drill string is further comprised of a pressure relief unit for dissipating pressure within the fluid passage.

27. A drilling assembly as claimed in claim 26 wherein the pressure relief unit is positioned between the casing string and the flow restriction device.

28. A drilling assembly as claimed in claim 24, wherein the lower drill string is further comprised of a shock absorbing unit for absorbing any impact of the bottom hole assembly.

29. A drilling assembly as claimed in claim 28 wherein the remainder of the lower drill string is comprised of the shock absorbing unit.

30. A drilling assembly as claimed in claim 28 wherein the shock absorbing unit is positioned between the casing string and the flow restriction device.

31. A drilling assembly as claimed in claim 24 wherein the constriction is formed at a latch coupling connected between the casing string and the remainder of the lower drill string, and wherein the fluid passage extends through the latch coupling.

32. A drilling assembly as claimed in claim 24 wherein the constriction is comprised of a funnel subassembly connected between the casing string and the remainder of the lower drill string, wherein the fluid passage extends through the funnel subassembly.

33. A method of drilling a wellbore comprising:

forming a drilling assembly comprising an upper drill string and a lower drill string which is telescoped over the upper drill string with a fluid passage extending through the upper drill string and the lower drill string for distributing fluid to a bottom hole assembly at the lower end of the lower drill string;

operating the drilling assembly according to the following cycle:

actuating the drilling assembly to a drilling mode and drilling a segment of a wellbore with the bottom hole assembly;

stopping drilling and retreating the bottom hole assembly from an end of the segment of the wellbore;

actuating the drilling assembly to a casing insertion and expansion mode and advancing the lower drill string past the upper drill string and simultaneously expanding a portion of a casing string at the upper end of the lower drill string by virtue of movement of the casing string past the upper drill string;

repeating the cycle when the lower drill string reaches the end of the segment of the wellbore until the desired wellbore depth is achieved.

34. A method as claimed in claim 33 in which actuating the drilling assembly to the casing insertion and expansion mode and advancing the lower drill string past the upper drill string includes controlling the flow of fluid in the fluid passage to increase the pressure in the fluid passage and to thereby cause relative movement of the lower drill string with respect to the upper drill string and to expand the casing string.

35. A method as claimed in claim 34 wherein controlling fluid flow in the fluid passage includes actuating a flow restriction device in the lower drill string to create increased pressure in the fluid passage above the flow restriction device.

36. A method as claimed in claim 34 including forming a constriction in the lower drill string to provide a location for the pressure to exert a net downward force on the lower drill string.

37. A method as claimed in claim 34 including providing a casing expander unit at a lower end of the upper drill string which acts to expand the portion of the casing string moving past the expander unit.

38. A method as claimed in claim 34 wherein the lower drill string includes a flow restriction device for controlling a flow of fluid through the fluid passage and wherein the step of actuating the drilling assembly to the drilling mode is comprised of actuating the flow restriction device to a first pressure regime wherein the flow of fluid through the fluid passage to the bottom hole assembly is substantially unrestricted.

39. A method as claimed in claim 38 wherein actuating the drilling assembly to the casing insertion and expansion mode is comprised of actuating the flow restriction device to a second pressure regime wherein the flow of fluid through the fluid passage to the bottom hole assembly is restricted such that a pressure is created in the fluid passage to thereby cause relative movement of the lower drill string with respect to the upper drill string and to expand the casing string.

40. A method as claimed in claim 39 further comprising forming a constriction in the lower drill string to provide a location for the pressure in the fluid passage to exert a net downward force on the lower drill string.

41. A method as claimed in claim 40 further comprising providing a casing expander unit at a lower end of the upper drill string which acts to expand the portion of the casing string moving past the expander unit.

42. A method as claimed in claim 34 wherein actuating the drilling assembly to the casing insertion and expansion mode is comprised of actuating the flow restriction device to a second pressure regime wherein the flow of fluid through the fluid passage to the bottom hole assembly is restricted such that a pressure is created in the fluid passage to thereby cause relative movement of the lower drill string with respect to the upper drill string and to expand the casing string.

43. A method as claimed in claim 42 further comprising forming a constriction in the lower drill string to provide a location for the pressure in the fluid passage to exert a net downward force on the lower drill string.

44. A method us claimed in claim 43 further comprising providing a casing expander unit at a lower end of the upper drill string which acts to expand the portion of the casing string moving past the expander unit.

* * * * *

UNITED STATES PATENT AND TRADEMARK OFFICE

CERTIFICATE OF CORRECTION

PATENT NO. : 7,287,603 B2
APPLICATION NO. : 10/496310
DATED : October 30, 2007
INVENTOR(S) : Richard T. Hay et al.

It is certified that error appears in the above-identified patent and that said Letters Patent is hereby corrected as shown below:

Column 10, line 55, delete “cycle;” and insert --cycle:--.
Column 10, line 60, delete “tower” and insert --lower--.
Column 11, line 14, delete “String” and insert --string--.
Column 11, line 40, delete “Pressure” and insert --pressure--.
Column 14, line 27, delete “us claimed” and insert --as claimed--.

Signed and Sealed this

Fifteenth Day of July, 2008

JON W. DUDAS
*Director of the United States Patent and Trademark Office*